US010087606B1

(12) United States Patent
Steffenauer

(10) Patent No.: US 10,087,606 B1
(45) Date of Patent: Oct. 2, 2018

(54) PLUMBING SYSTEM

(71) Applicant: Jacob Steffenauer, Fenton, MO (US)

(72) Inventor: Jacob Steffenauer, Fenton, MO (US)

( * ) Notice: Subject to any disclaimer, the term of this patent is extended or adjusted under 35 U.S.C. 154(b) by 234 days.

(21) Appl. No.: 14/727,626

(22) Filed: Jun. 1, 2015

Related U.S. Application Data

(60) Provisional application No. 61/997,530, filed on Jun. 2, 2014.

(51) Int. Cl.

| | |
|---|---|
| ***F24H 1/10*** | (2006.01) |
| ***E03B 7/04*** | (2006.01) |
| ***E03B 7/09*** | (2006.01) |
| ***F24H 1/12*** | (2006.01) |
| ***H05B 3/00*** | (2006.01) |
| ***H05B 3/06*** | (2006.01) |

(52) U.S. Cl.
CPC ..... *E03B 7/04* (2013.01); *E03B 7/09* (2013.01); *F24H 1/121* (2013.01); *H05B 3/0014* (2013.01); *H05B 3/06* (2013.01)

(58) Field of Classification Search
CPC ..... E03B 7/04; E03B 7/09; H05B 3/0014; H05B 3/06; F24H 1/121
USPC ..... 392/480, 449–454, 496, 397, 394; 219/341, 493, 328, 365, 331, 326, 501, 219/492, 497, 296, 499, 338
See application file for complete search history.

(56) References Cited

U.S. PATENT DOCUMENTS 2,760,047 A * 8/1956 Hanson ..... F24D 17/00 392/449
4,648,426 A * 3/1987 Oberholtzer ..... F24D 17/00 122/13.3

* cited by examiner

*Primary Examiner* — Phuong Nguyen
(74) *Attorney, Agent, or Firm* — Lewis Rice LLC

(57) ABSTRACT

Plumbing systems utilizing a single pipe with individual heating elements located in close proximity to individual plumbing fixtures. These provide users with the ability to control the temperature of water at the site of the individual fixture without need to mix hot and cold water to obtain a desired temperature.

3 Claims, 6 Drawing Sheets

PLUMBING SYSTEM

CROSS REFERENCE TO RELATED APPLICATION(S)

This Application claims benefit of U.S. Provisional Patent Application No. 61/997,530, filed Jun. 2, 2014, the entirety of which is expressly incorporated herein by reference.

BACKGROUND

1. Field of the Invention

This disclosure is related to the field of plumbing systems, particularly plumbing fixtures which utilize a single water line capable of providing a user with both hot and cold water at a plumbing fixture.

2. Description of the Related Art

Traditional household plumbing systems utilize two sets of pipes, one for hot water and one for cold water. In these systems hot water is usually provided via a hot water heater which is usually in the form of a tank with its own internal heat source such as a gas flame. More recently water heaters without tanks are being utilized, such heaters work by forcing water to pass through or around relatively large heating coils similar to that of air passing through the coils of an air conditioner. The pipes that provide cold water are usually connected almost directly to a city/utility water supply or via a pump from a well. These pipes run from the tank or supply line to various fixtures such as: washing machines, faucets, showerheads, spigots, dishwashers, etc.

These systems, while common, suffer from various shortcomings. The farther the fixture is from the hot water heater, the longer it takes for the user to receive hot water. This is because the pipes running from the hot water heater to a fixture will likely have residual water contained therein. When water is flowing out of a fixture and the user stops the flow of water at, for instance, a faucet, residual water remains in the pipes from the sup-ply line to the fixture. The heat contained in the water in the pipes dissipates and temperature equilibrium is achieved with ambient air after a certain amount of time. One solution is to insulate the pipes but that proves to be quite costly and the investment is usually not efficient because the extra energy necessary to heat additional water is a few orders of magnitude less than the energy (and resources) necessary to sufficiently insulate the pipes.

Another disadvantage is that the hot water heater tanks can fail and they sometimes leak. This can result in costly flood damage due to the large amount of water housed in such.

The hot water heaters that operate without a tank require a significant initial investment but do not present the same risks of having a tank which could fail inside of a dwelling. However, water heaters without tanks, e.g. tankless heaters, still suffer from the temperature of residual water in pipes, due to the factors discussed above and the longer the fixture is from the heater, the worse the problem is for the user.

SUMMARY

The following is a summary of the invention, which should provide to the reader a basic understanding of some aspects of the invention. This summary is not intended to identify critical elements of the invention or in any way to delineate the scope of the invention. The sole purpose of this summary is to present in simplified text some aspects of the invention as a prelude to the more detailed description presented below.

Described herein, among other things, is plumbing system where individual heat source(s) are utilized near the plumbing fixture and are used in conjunction with various valves, switches and control mechanisms for providing heated water throughout a home or office. This is particularly useful for applications where traditional water heaters are impossible.

There is described herein, in an embodiment, a plumbing system comprising: a water supply line; a water pipe; a plumbing fixture; a coiled heating element surrounding said water pipe; a thermostat, wherein said thermostat is controlled by a user; wherein water travels from said water supply line through said water pipe that is within said coiled heating element directly to said plumbing fixture without mixing with water from an additional supply line; and wherein temperature of water at said plumbing fixture is determined by said thermostat.

In an embodiment of the plumbing system the water supply line is a water main.

DETAILED DESCRIPTION OF THE PREFERRED EMBODIMENT(S)

Figure 2:
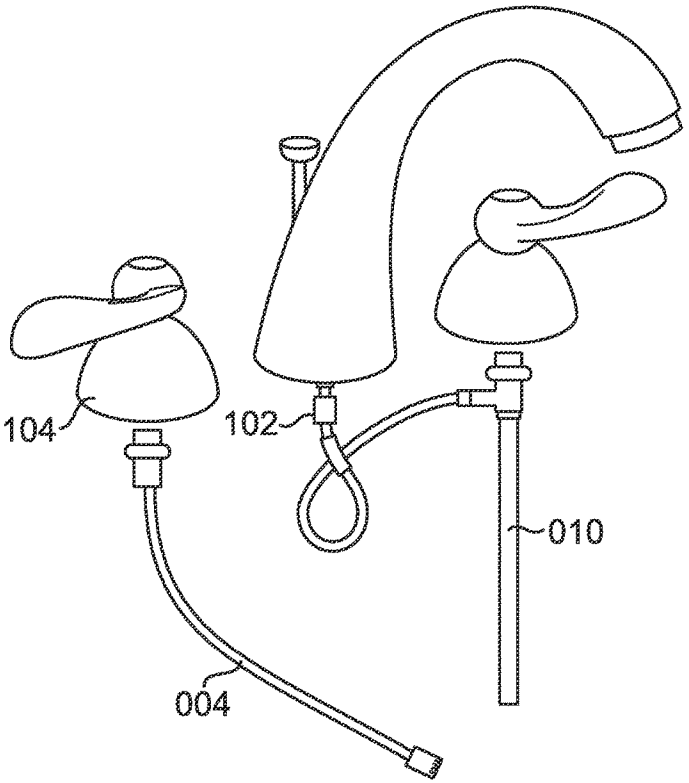
FIG. 2. depicts an embodiment of a plumbing system, specifically a single distribution line bathroom faucet.

Because of problems in the art associated with dual pipe systems and related fixtures, there are described herein various embodiments of single pipe systems and fixtures utilizing a heat source in proximity thereto.

Throughout this disclosure the term "plumbing fixture" is often used. The term is intended to encompass plumbing devices where water flow is controlled either by a user or through an automatic valve etc. Such devices such as faucets, spigots, washing machines, ice makers, dish washers, sprinkler systems, and/or showerheads.

The systems and methods described herein generally work by providing a heating coil which is positioned in close proximity to a faucet or other plumbing fixture. This is often immediately underneath the fixture or in a cabinet or wall adjacent the fixture. The coil surrounds a single input water line that will generally be filled with cold (more specifically it will usually be ambient temperature) water such as that supplied directly from a municipal source or attached well. The coil serves to heat the water in the single line upon demand for water at the plumbing fixture based on the temperature of water requested. This may be through a direct request for water of a certain temperature, or by the selection of a temperature based on the relative position of the facet handle(s) on a gradient of cold to hot as is well understood by those of ordinary skill in the art. In an embodiment, the control is provided by replacing the traditional faucet handle with an air gap switch control (e.g. a dimmer switch of the type commonly used in lighting).

As opposed to prior systems, hot water from a central water heater and cold water from a municipal line or well is not mixed at the faucet to produce the indicated temperature. Instead the single line is heated to the desired temperature and provided directly. Thus, the heat produced by the heating coil is determined based on the speed of water flowing through the line (which may be limited by flow limiting devices in the faucet) and the desired temperature. Thus, the coil will heat to a significantly greater temperature to produce a larger stream of hotter water than to produce a thin stream of only warm water. Because the temperature of ambient water can vary by seasonality and geographic location, the size of the heating coil may be selected based upon specific factors for the application such as desired maximum water temperature as well as the expected range of cold water input temperature. Further, in an embodiment, multiple heating coils arranged serially around the input pipe to the fixture may be provided to increase the available heat.

As should be apparent, use of these systems and methods generally eliminates the need to have a central water heater of any type as a unit may be provided with each fixture and there is no mixing of hot and cold water at the fixture. Further, since there is no mixing of cold and hot water, the maximum temperature to which the coil can heat the water can be reduced which can save energy.

Figure 1:
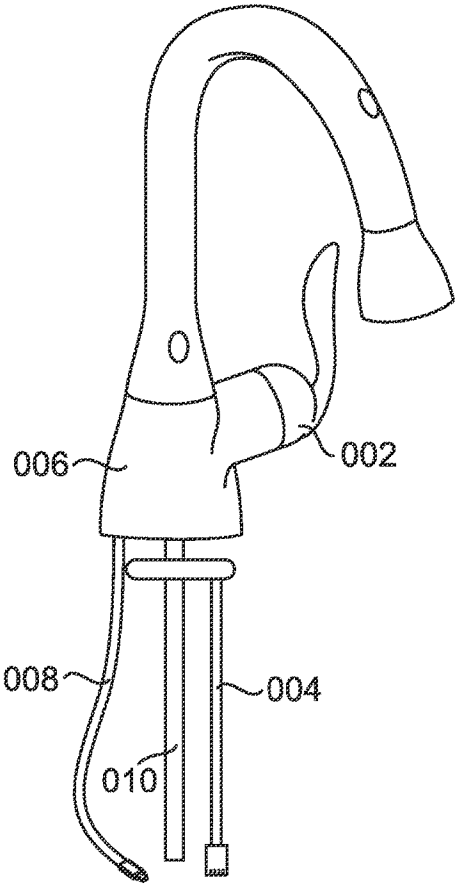
FIG. 1 depicts an embodiment of a plumbing system, specifically a single distribution line kitchen faucet.

FIG. 1 shows a kitchen faucet embodiment utilizing a single water pipe. The single ⅜" water line (010) leaving to a single port valve (006) which has a sensor power cord (008) and air gap switch cord (004) connected thereto. In this embodiment the user has the ability to control the temperature of the water via an air gap switch control with manual override (002).

FIG. 2 shows a bathroom faucet embodiment which utilizes a single water pipe. The hot water control knob, the gap switch control (104) is connected to the air gap switch cord (004). The ⅜" water line (010) connects to the single valve (102).

Figure 3:
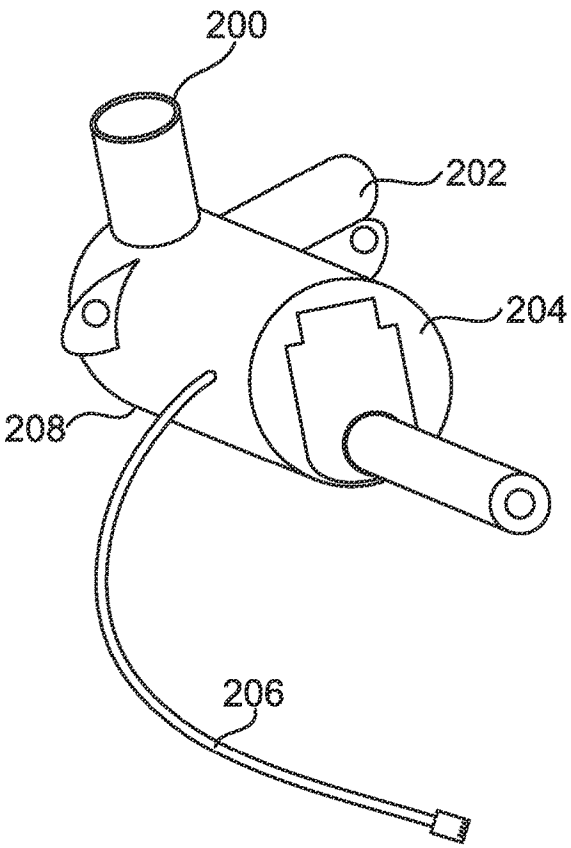
FIG. 3. depicts an embodiment of plumbing system, specifically a single distribution line shower faucet valve.

FIG. 3 shows a shower valve embodiment. The water input (202) is connected to the main body of the valve (208) which also contains the water output (200) and the air gap switch control (204) and also the air gap switch control wire (206).

Figure 4:
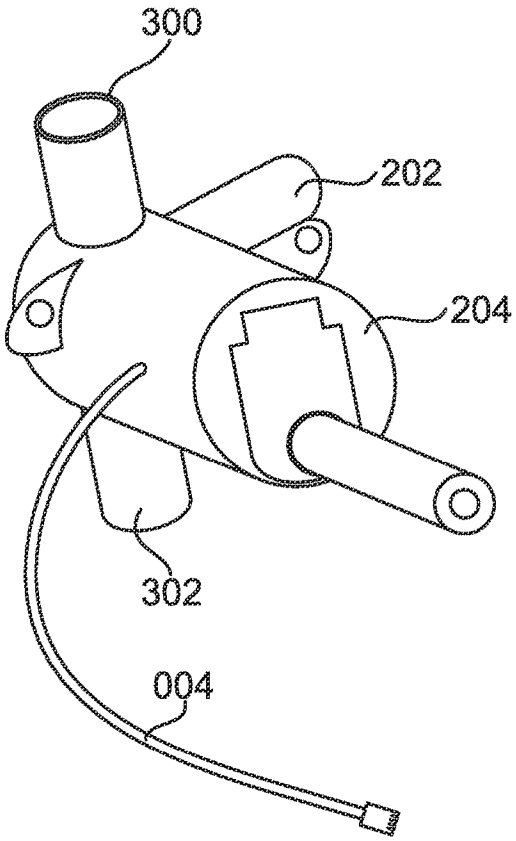
FIG. 4. depicts an embodiment of plumbing system, specifically a single distribution line bathtub spigot valve.

FIG. 4 shows a tub and shower combination valve embodiment. The air gap switch cord (004) is connected to the air gap switch control (204). The valve receives water from the water input (202) and the water is outputted by way of the shower output (300) or the tub output (302).

Figure 5:
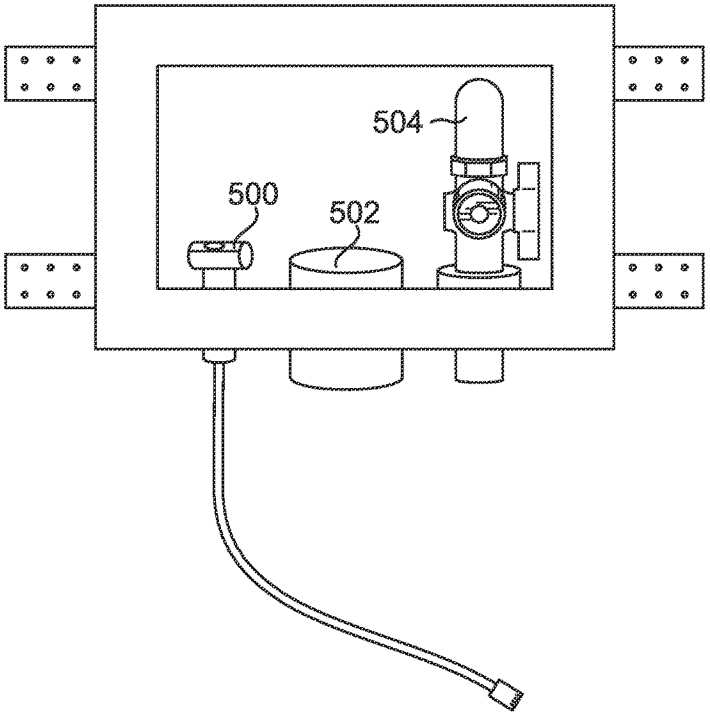
FIG. 5. depicts an embodiment of plumbing system, specifically a single distribution line laundry box.

FIG. 5 shows a laundry box embodiment. The box comprises of an air gap witch extension plug and cord (500), the discharge outlet (502) and the water valve (504).

Figure 6:
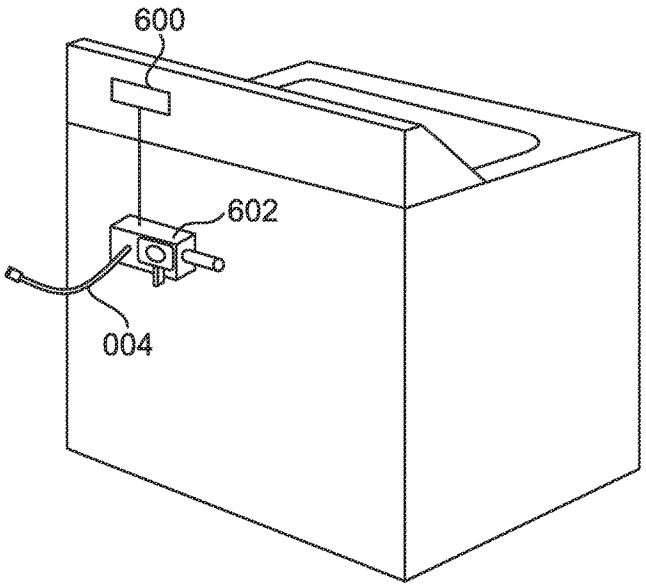
FIG. 6. depicts an embodiment of plumbing system, specifically a single distribution line clothes washing machine.

FIG. 6 shows a washing machine embodiment. The air gap switch control (600) connects to the single input water valve (602) and has an air gap switch cord (004).

Figure 7:
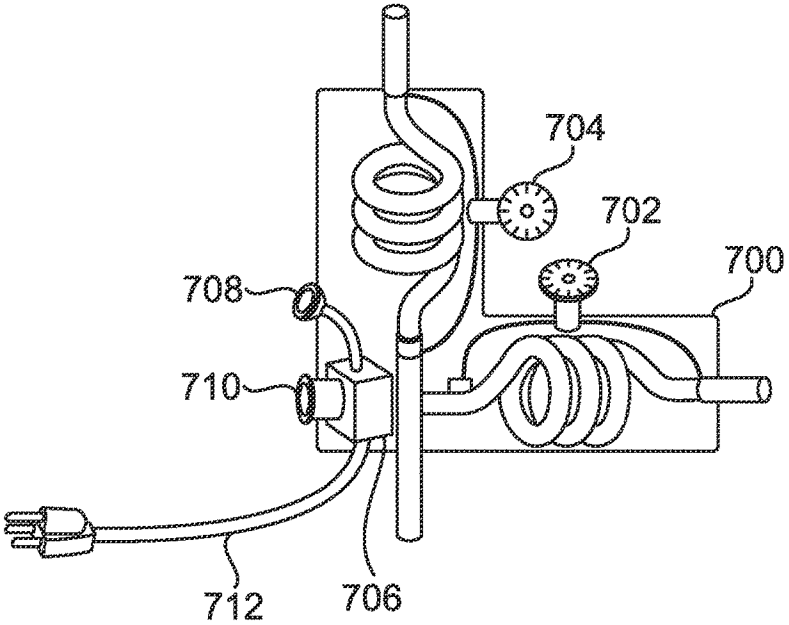
FIG. 7. depicts an embodiment of plumbing system, specifically a single distribution line dishwasher coil.

FIG. 7 shows a dishwasher coil embodiment. Located inside the cover (700) are the thermostats (702) which, in some embodiments, have external temperature gauges (704). The convention box for electric distribution (706) houses the air gap plug inlet (708) and the sensor faucet a/c source plug inlet (710) and the ac cord (712).

Figure 8:
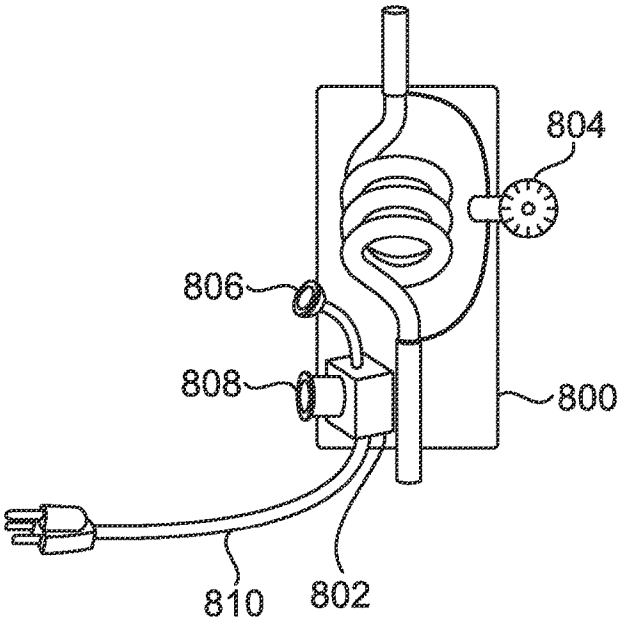
FIG. 8. depicts an embodiment of plumbing system, specifically a single distribution line washing machine coil.

FIG. 8 shows a washing machine coil embodiment. The convention box for electric distribution (802) has a cover (800). Located on the outside of the cover (800) feeding to the inside is a thermostat (804), an air gap switch plug inlet (806), the sensor faucet alternating current (AC) source plug inlet (808) and an AC cord (810).

Figure 9:
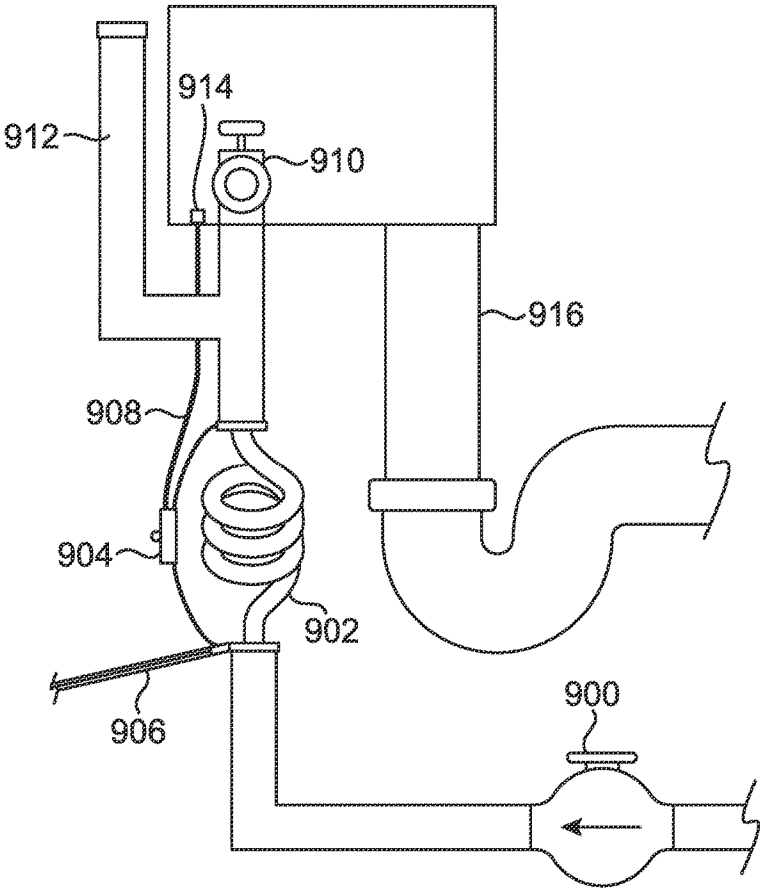
FIG. 9. depicts an embodiment of plumbing system, specifically a single distribution line laundry unit diagram.

FIG. 9 shows a coil control embodiment for a washing machine box utilizing an air gap switch. The flow of water entering the system can be controlled by the ball valve (900) leading to the ½" water heating coil (902) which has a thermostat (904) connected thereto, and is provided power by the ac power source (906), also connected to the thermostat (904) is the control sensor wire (908). The water from the heating coil (902) is led to the washer hookup (910). Also included in the system is an air chamber (912), which extends from the pipe connecting the coil (902) and the washer hookup (910) and extended vertically above the hookup (910). The sensor wire (908) leads to the sensor plugin (914). The washing machine drain and trap (916) is also shown.

Figure 10:
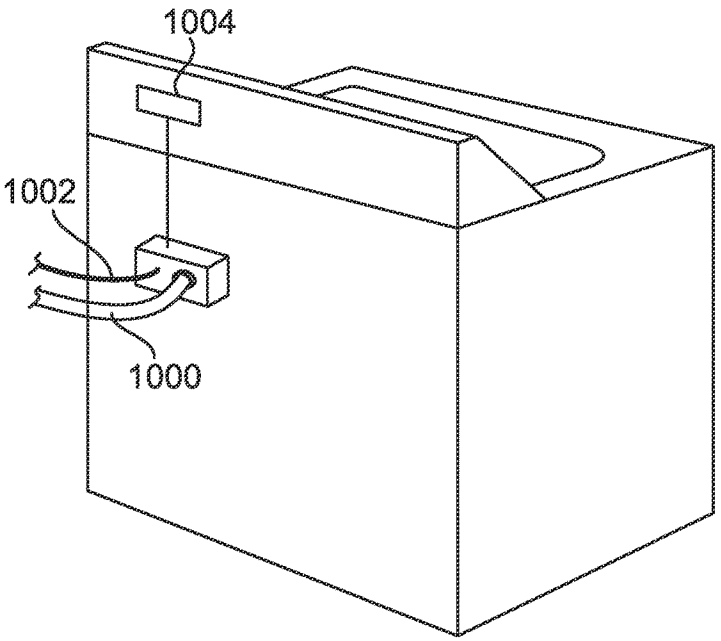
FIG. 10. depicts an embodiment of plumbing system, specifically the rear of a single distribution line clothes washing machine connection.

FIG. 10 shows the rear of a washing machine embodiment utilizing an air gap switch. The water hookup (1000) and sensor wire (1002) connect to the rear of the washing machine. The water temperature is controlled by the user via a coil control dial or digital setting dimmer type control (1004)

Figure 11:
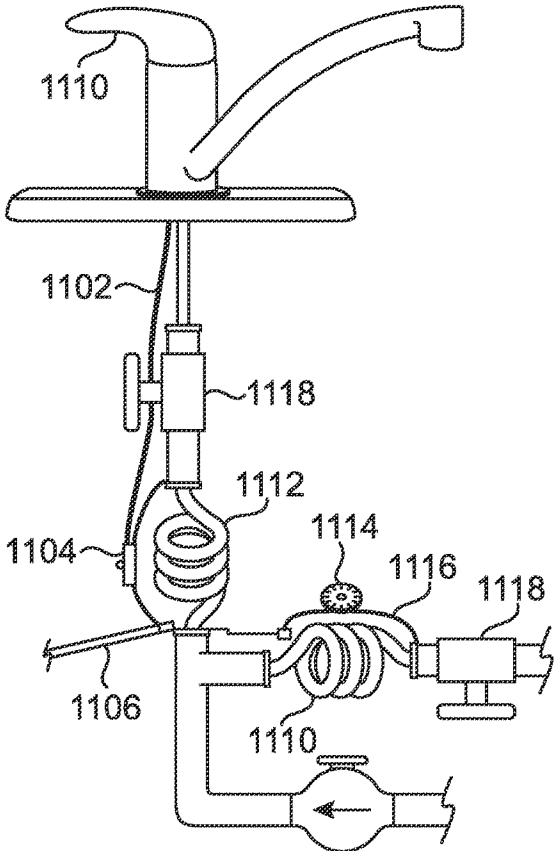
FIG. 11. depicts an embodiment of plumbing system, specifically a single distribution line kitchen faucet and dishwasher combination.

FIG. 11 shows a combination kitchen faucet and dishwasher combination using an air gap switch. The user interfaces with the control dial (1100) to specify the desired temperature of water. The control dial (1100) is connected to the temperature control wire (1102) which is connected to a thermostat (1104) which is also connected to an AC power source (1106). Water enters the embodiment of this system after it passes through the ½" ball valve (1108) and then splits into two separate ½" coils (1110 and 1112). A thermostat (1114) controls the coil leading to the dishwasher (1110) which is also supplied power by the ac power source (1106). In some embodiments the coil leading to the dishwasher (1110) will be activated by a motion sensor in the coil (1116). Also included in this particular system embodiment are stop valves (1118).

Figure 12:
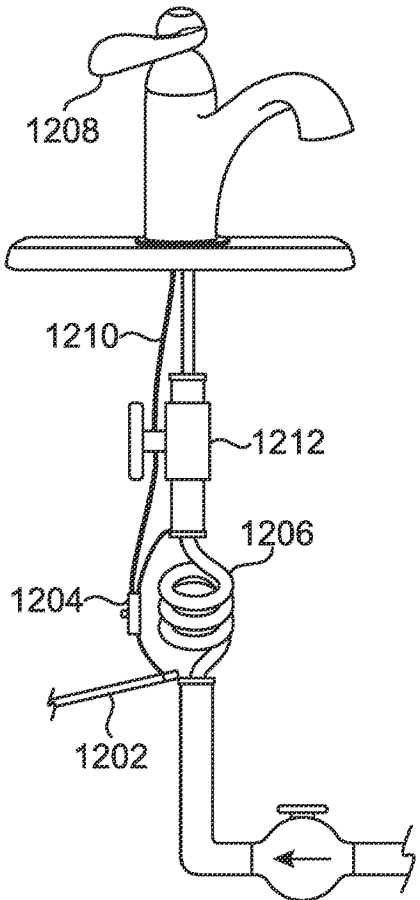
FIG. 12. depicts an embodiment of plumbing system, specifically a single distribution line bathroom faucet.

FIG. 12 shows an embodiment of a bathroom faucet using an air gap switch. Water enters the system after passing through a ½" ball valve (1200). An AC power source (1202) is connected to a thermostat (1204) which controls the temperature of the water passing through the ½" heating coil (1206), and the temperature of such is controlled by the user via the control dial (1208) which uses a temperature control wire (1210) to connect the thermostat (1204) to the control dial (1208). Also depicted is a stop valve (1212).

Figure 13:
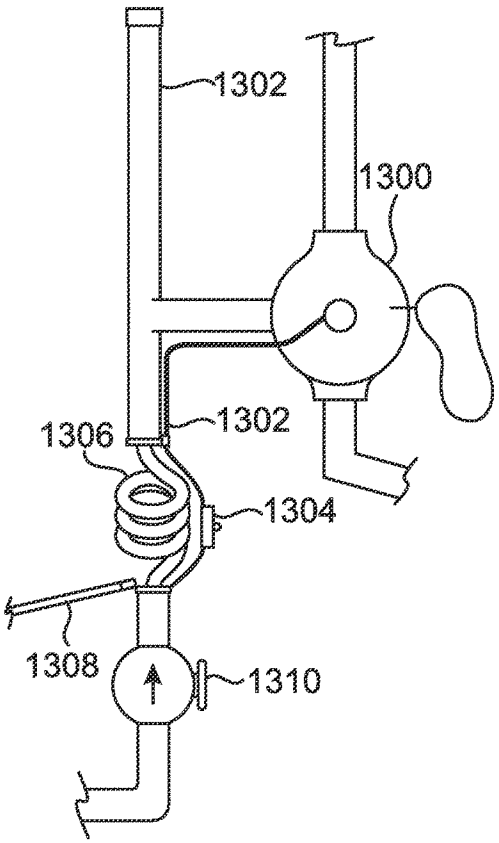
FIG. 13. depicts an embodiment of plumbing system, specifically a single distribution line bathtub and shower combination.

FIG. 13 shows an embodiment of a tub and shower valve using an air gap switch. The control dial (1300) is connected to a temperature control wire (1302), which is connected to a thermostat (1304). The thermostat (1304) controls the temperature of the water in the ½" coil (1306) and is supplied power by the ac power source (1308). Water entering the system is controlled via a valve (1310). Situated at a distance above the control dial (1300) is an air chamber (1312).

While the invention has been disclosed in conjunction with a description of certain embodiments, including those that are currently believed to be preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. A plumbing system comprising:

a water supply line not connected to a central water heater and including water at a first temperature;

a water pipe directly connected to said water supply line;

a plumbing fixture connected to said water pipe;

a coiled heating element surrounding said water pipe;

a thermostat, wherein said thermostat is controlled by a user;

wherein water travels from said water supply line:

into said water pipe that is within said coiled heating element; and from said water pipe within said coiled heating element directly to said plumbing fixture without said water from said water supply line mixing with water from an additional supply line prior to being discharged from said plumbing fixture;

wherein water is discharged by said plumbing fixture at a temperature equal to or greater than said first temperature and less than a second temperature; and wherein said temperature of said discharged water is:

selectable by said thermostat to be any temperature equal to or above said first temperature and below said second temperature; and essentially constant regardless of the amount of water discharged by said plumbing fixture.

2. The plumbing system of claim 1, wherein said water supply line is a municipal water main.

3. The plumbing system of claim 1, wherein said water supply line is directly connected to a water well.

* * * * *